United States Patent [19]

Lundberg

[11] 4,273,061

[45] Jun. 16, 1981

[54] FLOATING DOCK

[75] Inventor: Thorsten Lundberg, Askim, Sweden

[73] Assignee: Gotaverken Arendal AB, Gothenburg, Sweden

[21] Appl. No.: 909,681

[22] Filed: May 25, 1978

[51] Int. Cl.[3] ..... B63B 1/06

[52] U.S. Cl. ..... 114/45

[58] Field of Search ..... 114/45, 55, 74 R, 72, 114/44, 74 A, 48; 37/78

[56] References Cited

U.S. PATENT DOCUMENTS

| | | | |
|---|---|---|---|
| 1,699,709 | 1/1929 | Ono | 114/74 R |
| 2,500,354 | 3/1950 | Harris | 114/45 |
| 3,406,650 | 10/1968 | Miller | 114/45 |
| 4,111,144 | 9/1978 | Ingvason | 114/48 |

*Primary Examiner*—Sherman D. Basinger
*Attorney, Agent, or Firm*—Cantor and Singer

[57] ABSTRACT

A floating dock of the type comprising a bottom structure and two side walls is provided with a service tunnel extending longitudinally through the bottom structure, and housing the ballast pumps. The bottom plating is inclined upwardly from the longitudinal middle line of the dock, and the outlets from the ballast pumps are formed so as to direct the flow of expelled water outwardly along the inclined bottom plating.

2 Claims, 1 Drawing Figure

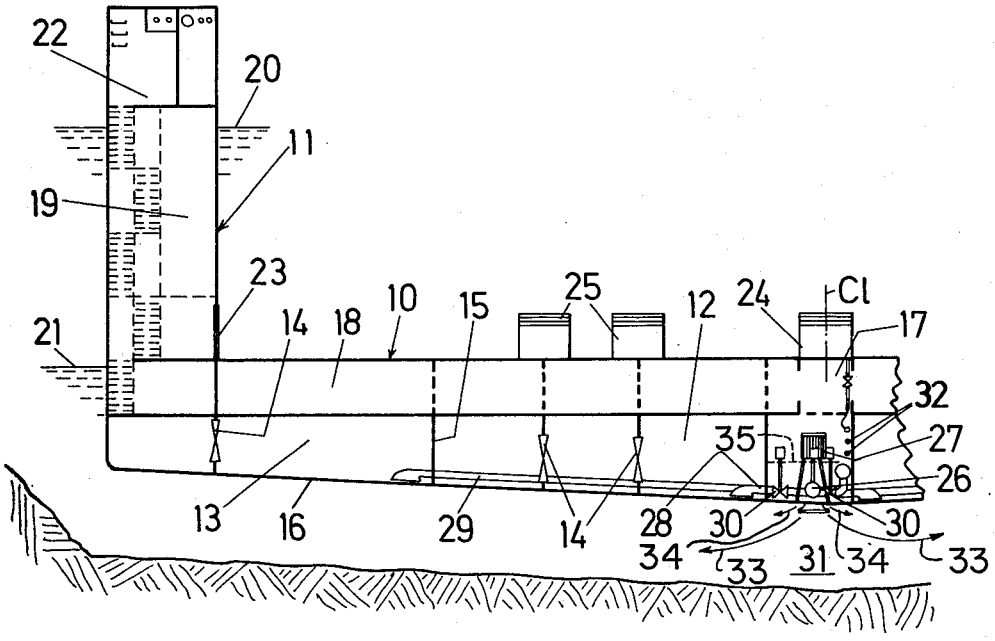
22
20
11
19
23
21
14
18
10
15
25
12
24
Cl
17
32
35
27
26
13
16
29
14
28
30
30
34
33
31
34
33

FLOATING DOCK

BACKGROUND OF THE INVENTION

A floating dock of conventional type comprises a supporting bottom structure having side walls along its longitudinal sides for providing i.a. the necessary stability, when the dock is lowered. The bottom structure includes a number of displacement tanks, which are filled with water, when the dock is to be sunk, and which must be emptied when the dock is to be raised.

The pumps for handling the ballast water are usually located in the lower parts of the side walls, while their driving motors are accommodated higher up in the side walls, in spaces which during most of the working time will remain above water level. The transfer of torque is obtained by means of long, vertical shafts, for which it is difficult to provide satisfactory journalling and lubrication. The outlets from the pumps are directed horizontally outwards from the dock's sides.

In order to accommodate the lowered dock a well is often excavated in the sea-bed outside the quay or pier, where the dock is moored, and it is evident, that there is a big risk of such well being filled with mud and debris.

The most heavily stressed portion of the dock is located along the centre line of the bottom structure, and it is desirable to locally strengthen this portion.

SUMMARY OF THE INVENTION

Above points have been taken into regard, when the bottom structure, according to the invention is provided with a bottom plating, being downwardly inclined, from the longitudinal sides of the structure towards the longitudinal centre line, and a service tunnel extends centrally through the bottom structure and accommodates the pumps adapted to withdraw water from the displacement tanks, the outlets from said pumps being directed downwardly, along the bottom plating of the structure.

The service tunnel will strengthen the longitudinal middle portion of the bottom structure, which, together with the upwardly inclined bottom plating, means a good utilization of the strength of the material. The inclined bottom will also mean small volumes of water residue in the displacement tanks and the location of the pumps permits the use of short suction conduits. As the outlets from the pumps are directed downwards an automatic scavenging of the dock well is obtained during each raising operation.

BRIEF DESCRIPTION OF THE DRAWING

The single drawing shows a portion of a cross section through a floating dock according to the invention.

DESCRIPTION OF A PREFERRED EMBODIMENT

The dock includes an elongate bottom structure 10 and side walls 11, extending along the longitudinal sides thereof. Only one of these side walls is shown in the drawing. Within the bottom structure there is, in a conventional manner, a plurality of displacement tanks. Some of these tanks, 12, are grouped symmetrically to both sides of the centre line, CL, of the dock, while other tanks, 13, are located along the outward parts of the bottom structure. These tanks are, in the longitudinal direction of the dock, subdivided into compartments, and these are further subdivided by means of open bulkheads 14. A longitudinal bulkhead 15, within each half of the bottom structure forms a watertight division between the compartments of tanks of 12 and 13.

The bottom structure 10 is designed in such a manner, that the bottom plating 16 is inclined downwardly/inwardly, from the longitudinal sides of the dock towards its center line CL.

Due to this form of the bottom plating, tanks 12 will obtain an increased capacity, compared to a conventional dock with a flat bottom, which means an increased lifting capacity in the central part of the bottom structure, where the weight of a ship to be docked mainly will rest. The internally sloping bottom will also mean a reduction of ballast water residues in the empty tanks, and these will also be more easily cleaned.

A service tunnel 17 is provided centrally in the bottom structure, running substantially in its full length. At least one transverse tunnel 18 connects the service tunnel with a watertight staircase 19 within at least one of the side walls 11.

When the dock is in its lowered position the level 20 of the water will reach up high along the side walls. When the dock is raised the deck of the bottom structure is located above water level 21, as indicated in the drawing. Access to the tunnels may thus, at any time, be obtained from passage 22 running along the upper part of the side wall, above water level 20. In order to facilitate communication with the service tunnel, when the dock is raised, each staircase 19 is provided with a watertight door 23, at deck level.

The service tunnel 17 forms a longitudinal strengthening below central keel-blocks 24. Some of bulkheads 14 are located so they form supports for sideward keel-blocks 25.

Pumps 26, driven by electric motors 27 located directly at the pumps, are mounted within service tunnel 17, and are together with associated valves 30 easily accessible for service and overhaul within the dry compartment provided by the tunnel. Suction pipes 28, 29 connect the pumps with tanks 12 and 13. Due to the central location of the pumps, and by way of suitably fitted valves 30 the total number of pumps may be reduced, and the suction pipes will be comparatively short.

On many occasions a floating dock will be moored along a quay or a pier and it may be desirable to excavate a well 31 in the sea-bed, of sufficient depth to ensure that the deck of the bottom structure will be about level with sea-bed, when the dock is sunk.

The outlets from the pumps 26 are directed downwardly/outwardly as indicated by arrows 33 and the forceful jets of water indicated by arrows 34, caused by pumps located close by the outlets, will, during each raising operation, scavenge the well and wash out mud and debris having drifted down into the well.

The service tunnel further accommodate supply conduits 32 for electricity, compressed air, steam, fresh and salt water, as well as drain conduits. These conduits may be connected to a docked ship by way of posts or valves fitted in the deck of the bottom structure. In such manner the number of hoses and cables on the deck is reduced and the companion ways along the side walls remain free. 35 is a platform.

What I claim is:

1. A floating dock comprising a ship supporting bottom structure enclosing a plurality of ballast tanks disposed on either side of the longitudinal center line of said dock, and two longitudinal side walls extending upwards from said bottom structure, a bottom plating, downwardly defining said bottom structure and being downwardly inclined from the longitudinal sides of the bottom structure towards its longitudinal center line, a service tunnel within said bottom structure, extending centrally in its longitudinal direction, said ballast tanks being floodable for lowering the dock, pump means for removing water from said ballast tanks for raising the dock, said pump means being located in said service tunnel and having outlets below the same, said outlets directing flow of water outwardly along the inclined bottom plating, and at least one watertight staircase within one of said side walls extending from a portion thereof remaining above water level even when the dock is brought to a lowered position, and into said bottom structure, as well as a transverse tunnel communicating said staircase with said central service tunnel.

2. The floating dock according to claim 1, in which longitudinal bulkheads separating said service tunnel from adjacent ballast tanks are adapted to support ship carrying keel blocks at the supporting deck of said bottom structure.

* * * * *